US005139075A

United States Patent [19]

Desrochers

[11] Patent Number: 5,139,075

[45] Date of Patent: Aug. 18, 1992

[54] OPERATOR FOR A ROLLING DOOR ASSEMBLY

[76] Inventor: Eddy Desrochers, 3035 Pierre Thomas Hurteau, App 2, St-Hubert, Quebec, Canada

[21] Appl. No.: 708,653

[22] Filed: May 31, 1991

[51] Int. Cl.[5] ..... E06B 9/20

[52] U.S. Cl. ..... 160/310; 160/188; 160/265; 160/321; 192/48.91; 192/94

[58] Field of Search ..... 160/310, 133, 188, 189, 160/265, 311, 312, 321; 192/48.91, 94

[56] References Cited

U.S. PATENT DOCUMENTS

| | | | |
|---|---|---|---|
| 824,805 | 7/1906 | Muller | 192/48.91 X |
| 2,504,018 | 4/1950 | Gibson et al. | 192/94 X |
| 3,512,302 | 5/1970 | Sivin et al. | 160/188 X |
| 3,853,167 | 12/1974 | Wardlaw | 160/133 |
| 4,478,268 | 10/1984 | Palmer | 160/310 |
| 4,690,195 | 9/1987 | Taylor | 160/133 X |
| 4,976,302 | 12/1990 | Taylor | 160/310 X |
| 5,025,847 | 6/1991 | Mueller | 160/133 X |

*Primary Examiner*—David M. Purol
*Attorney, Agent, or Firm*—Jeffrey T. Imai; Arne I. Fors; D. Doak Horne

[57] ABSTRACT

A rolling or overhead door assembly is disclosed comprising a shaft having an external thread bounded by a first and second bearing surface, a hub screwingly engaging the shaft and adapted to travel along the shaft, a first sprocket rotatably mounted on the first bearing surface and operably connected with a take-down device for unrolling a flexible door and a second sprocket mounted on the second bearing surface and operably connected with a take-up roller for rolling up the door, and abutments on opposite sides of the first and second sprocket. Upon rotation of the shaft the hub advances along the shaft and frictionally engages the first sprocket until the first sprocket and shaft rotate together and upon counter rotation of the shaft the hub advances back along the shaft and frictionally engages the second sprocket until the second sprocket and shaft rotate together.

19 Claims, 10 Drawing Sheets

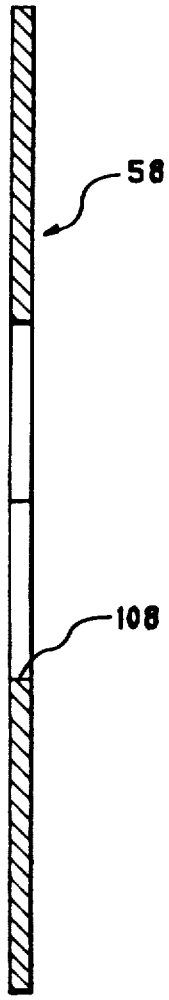
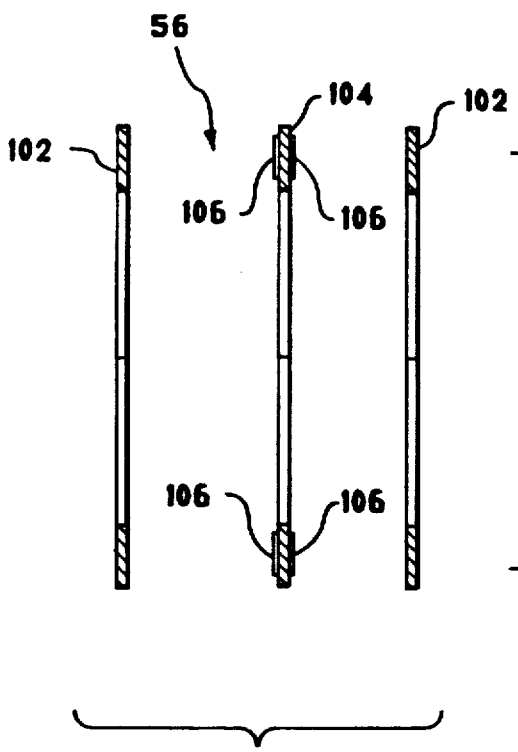
FIG.9.
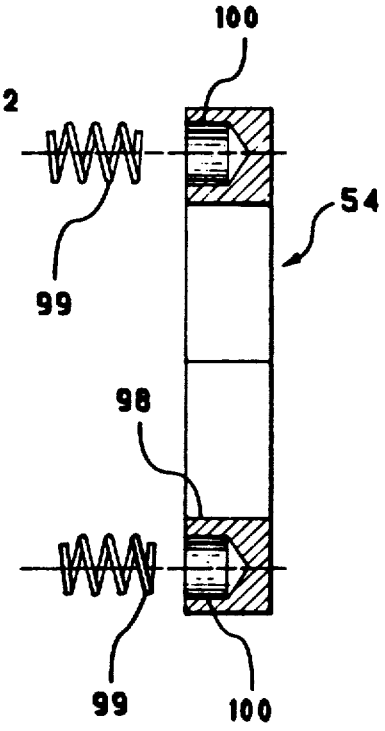
FIG.8.
FIG.10.

OPERATOR FOR A ROLLING DOOR ASSEMBLY

FIELD OF INVENTION

This invention relates to rolling and overhead doors and in particular to operating systems for opening and closing doors of this type.

BACKGROUND OF INVENTION

In the prior art rolling and overhead doors, one electric motor is generally used to selectively drive the take-up barrel and the take-down barrel in the case of a rolling door and a drum cable system in the case of overhead doors. In order to accomplish this task, an actuator is required to selectively drive each barrel or drum cable system for opening and closing a rolling or overhead door. Accordingly, the operator of the prior art device has many precision components which are not only bulky increasing the space requirements for installing such a device but also requiring a high degree of servicing increasing operating costs of such devices. Further, since the actuator remains engaged with either the take-up barrel or the take-down barrel, the device may not be operated manually in the event of a power loss. If the door cannot be opened or closed manually, entry of rescue personnel or the exit of trapped workers may be prevented.

U.S. Pat. No. 4,690,195, issued Sep. 1, 1987, discloses an operator for a rolling door which provides a power operator means for both rolling the door up and pulling the door downwards to the closing position. The rolling door is particularly useful in a medium pressure environment such as those found in mines.

In the second embodiment of U.S. Pat. No. 4,690,195, a single drive motor operates the take-up barrel and the take-down barrel by chain drive. The embodiment has found to be unsuitable as the components are required to be of high precision and accordingly have high replacement and servicing costs. Further, such system is slow and unresponsive as the engagement between parts is slow. Further, the sprockets being driven by the chain must be selected in accordance with the door height and the required door opening speed. Further, since the take-up barrel and the take-down barrel are driven at the same time, there are times when the door is either under-tensioned or over-tensioned during the travel since the diameter of the take-up barrel varies with the amount of door extended. Further, since one chain travels around at least three sprockets, the operator cannot be placed over the hood of the device thereby limiting the locations where the device can be installed.

SUMMARY OF THE INVENTION

The disadvantages of the prior art may be overcome by providing a device which selectively drives a take-up roller and a take-down device. In particular, the invention provides an operator which upon rotation drives a take-up roller for opening the roller door, permitting the take down roller to freely rotate and on counter rotation drives a take-down device for closing the door, permitting the take-up roller to freely rotate.

According to one aspect of the invention there is provided a selective clutch for selectively rotating at least two disc means, comprising a shaft having an external thread bounded by a first and second bearing surface, a hub having an axially extending threaded opening for screwingly engaging the thread of said shaft, a first disc means rotatably mounted on said first bearing surface, a second disc means rotatably mounted on said second bearing surface, abutment means on opposite sides of said first and second disc means for retaining said first and second disc means on said shaft, first and second biasing means between said first disc means and abutment means and said second disc means and abutment means, respectively, urging said disc means in frictional contact with said hub. Rotation of said shaft said hub advances therealong and frictionally engages said first disc means until said first disc means and shaft rotate together and said second disc means freely rotates. Counter rotation of said shaft said hub advances back along said shaft and frictionally engages said second disc means until said second disc means and shaft rotate together and said first disc means freely rotates.

According to another aspect of the invention there is provided a rolling or overhead door assembly comprising a shaft having an external thread bounded by a first and second bearing surface, a hub screwingly engaging the shaft and adapted to travel along the shaft, a first disc means rotatably mounted on said first bearing surface and operably connected with a take-down device for unrolling a flexible door or closing an overhead door and a second disc means mounted on said second bearing surface and operably connected with a take-up roller for rolling up the door or with a drum cable system for opening an overhead door, and abutment means on opposite sides of said first and second sprocket. Upon rotation of the shaft said hub advances along said shaft and frictionally engages said first disc means until the first disc means and shaft rotate together and the second disc means rotates freely. Counter rotation of the shaft the hub advances back along the shaft and frictionally engages the second disc means until the second disc means and shaft rotate together and the first disc means rotates freely.

BRIEF DESCRIPTION OF THE DRAWINGS

An embodiment of the invention is illustrated in the drawing, in which:

FIG. 8 is sectional view of a collar of the operator of the embodiment of FIG. 1;

FIG. 9 is sectional view of a thrust bearing of the operator of the embodiment of FIG. 1;

FIG. 10 is sectional view of a friction disc of the operator of the embodiment of FIG. 1;

DETAILED DESCRIPTION OF THE PREFERRED EMBODIMENT

Figure 1:
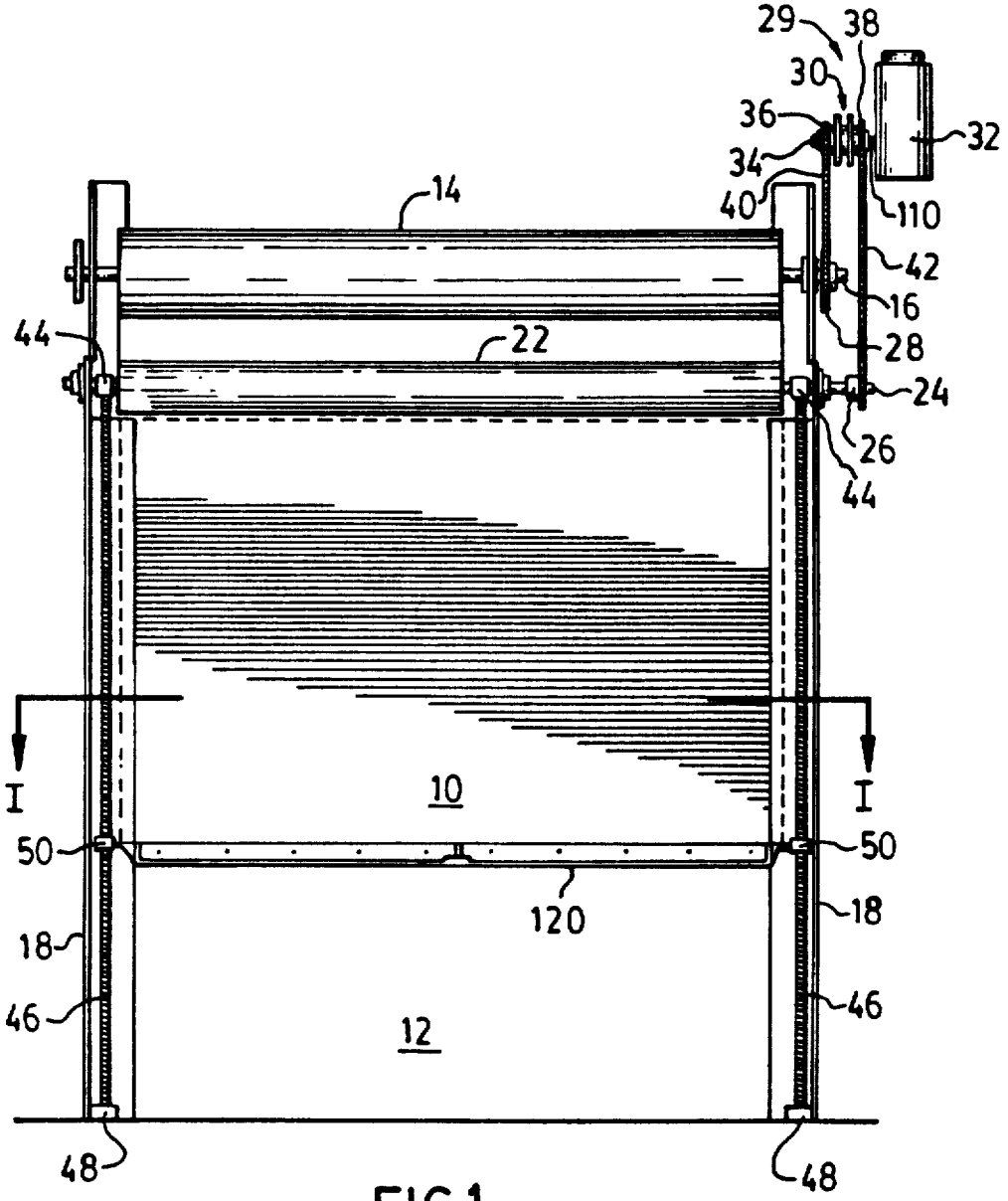
FIG. 1 is a front elevational view of the roller door and operator according to the present invention.
Figure 2:
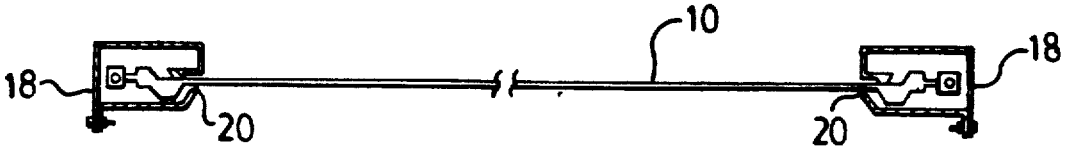
FIG. 2 is a sectional view along the line I—I of the embodiment of FIG. 1 illustrating the door within the side channels.
Figure 3:
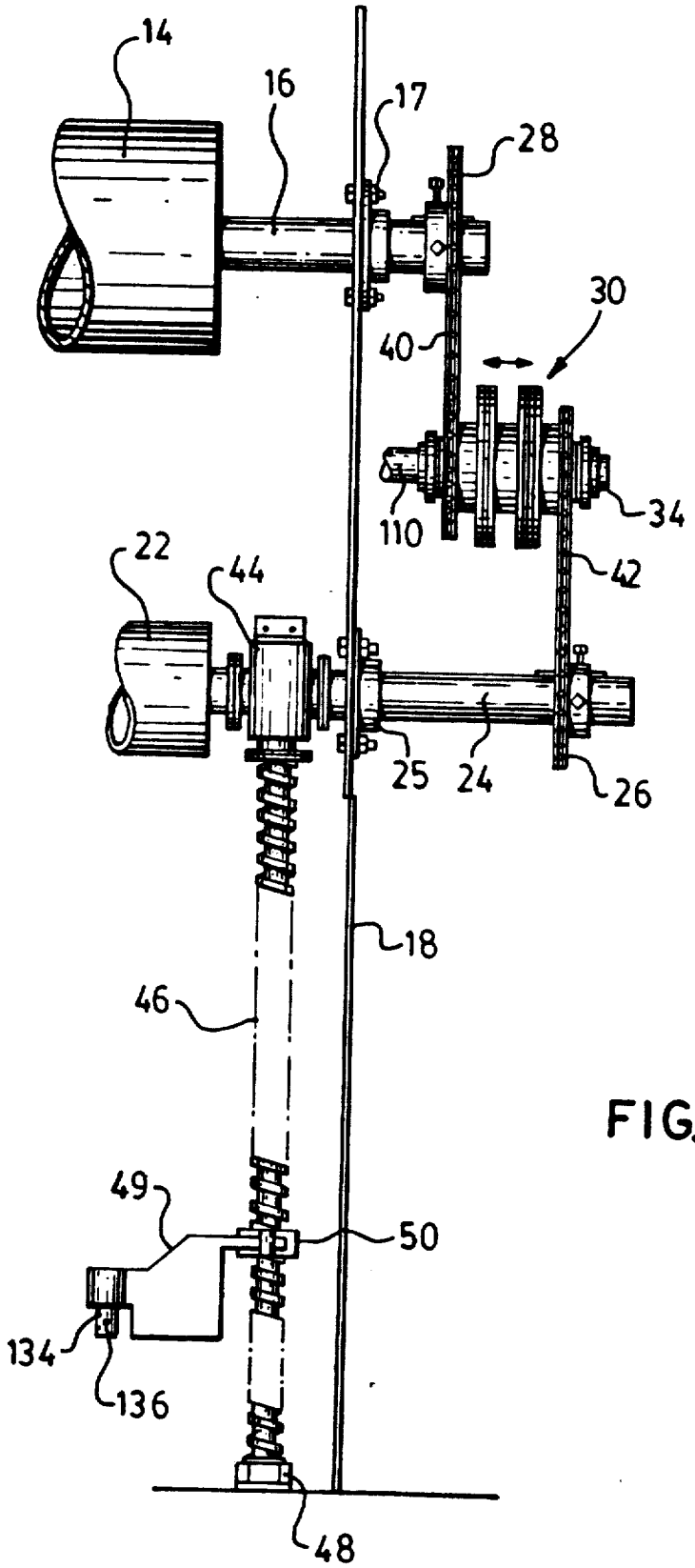
FIG. 3 is a partial front elevational view of the embodiment of FIG. 1.

As illustrated in FIG. 1, the roller door consists of a door curtain 10 which can be rolled up, which is made preferably from a flexible material, and which can be unwound for closing a door opening 12. Above the door opening is mounted a take-up roller 14 connected to door curtain 10. Take-up roller 14 is rotatably mounted about take-up axle 16 for integral rotation therewith. On each side of the door opening 12 is a frame 18 for receiving the edge of door curtain 10. Frame 18 is fixed to the wall surface immediately adjacent to the door opening 12 presenting a channel 20 for receiving door curtain 10.

Guide roller or idler roller 22 is mounted on idler axle 24 which is in turn mounted on frame 18 for rotation substantially perpendicular to the direction of the opening of the door curtain 10. Idler roller 22 guides door curtain 10 into the guide channels 20. At one end of idler axle 24, idler sprocket 26 is fixedly mounted thereon. Similarly at the end of take-up axle 16, take-up sprocket 28 is mounted thereon. Axles 16 and 24 are suitably mounted for rotation in bearings 17 and 25, respectively, mounted on each side frame 18.

Axles 16 and 24 upon being drivenly rotated by sprockets 28 and 26 respectively, will rotate idler roller 22 and take-up roller 14, respectively.

Operator 29 generally comprises a selective clutch drive 30 and a drive motor 32. Drive motor 32 is mounted at a convenient location and operable to rotate clutch shaft 34. Clutch 30 is mounted on clutch shaft 34 and has take-up drive sprocket 36 and idler drive sprocket 38.

Take-up chain 40 extends about take-up drive sprocket 36 and take-up sprocket 28 presenting an endless chain. Similarly, idler chain 42 extends about idler drive sprocket 38 and idler sprocket 26 presenting an endless chain. Mounted on each end of idler axle 24, between frame 18 and idler roller 22 is take-down gear 44 for engaging with take-down screw shaft 46. Take-down screw shaft 46 is mounted in base pads 48 for rotational movement. Dog 50 has an internal bore having a complementary thread and spring loaded trigger for engaging screw shaft 46 while closing and disengaging the screw shaft while opening. The lower outer edge component 49 is connected between dog 50 and door curtain 10. Dog 18 is releasably connected to edge component 49 to permit emergency opening of the door curtain.

Figure 4:
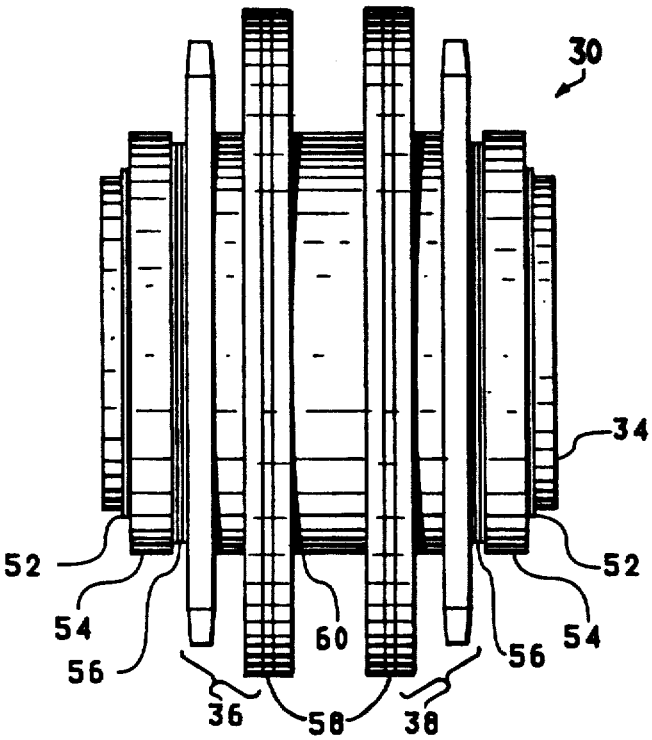
FIG. 4 is a view of the selective clutch drive of the operator of the embodiment of FIG. 1.
Figure 7:
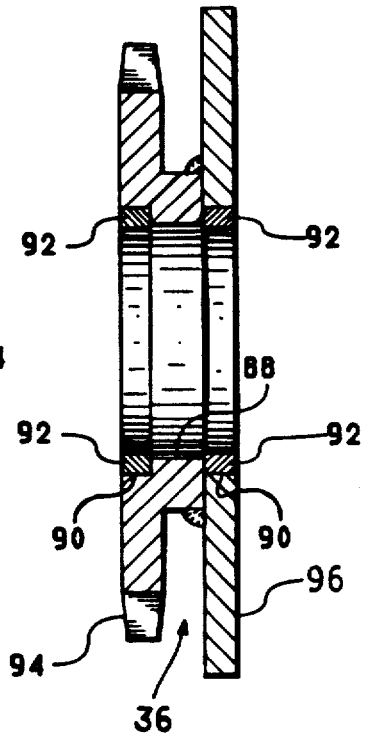
FIG. 7 is sectional view of a sprocket of the operator of the embodiment of FIG. 1.
Figure 6:
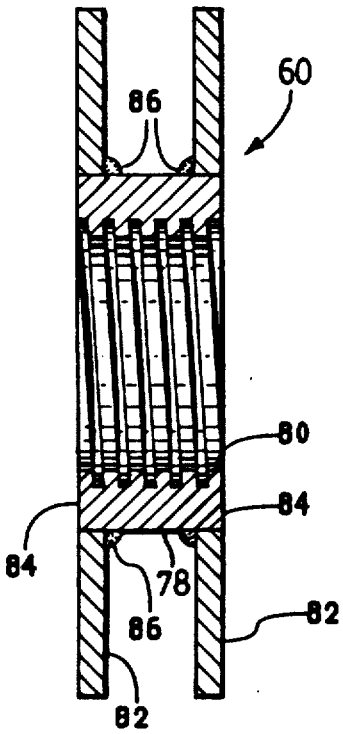
FIG. 6 is a sectional view of the screw hub of the operator of the embodiment of FIG. 1.

Clutch 30 generally comprises retaining ring 52, collar 54, thrust bearing 56, sprockets 36 and 38, friction disc 58 and screw hub 60, all mounted on clutch shaft 34. As illustrated in FIG. 4, clutch 30 has screw hub 60 mounted at the axial mid-length of clutch shaft 34 and axially therefrom has equivalent components on each side thereof.

Figure 5:
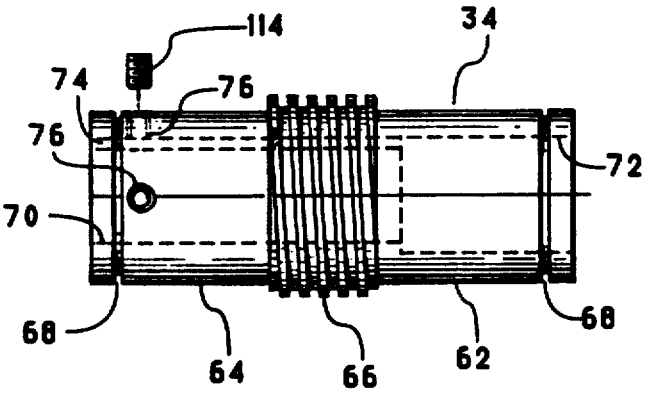
FIG. 5 is a plan view of the clutch shaft of the operator of the embodiment of FIG. 1.
Figure 11:
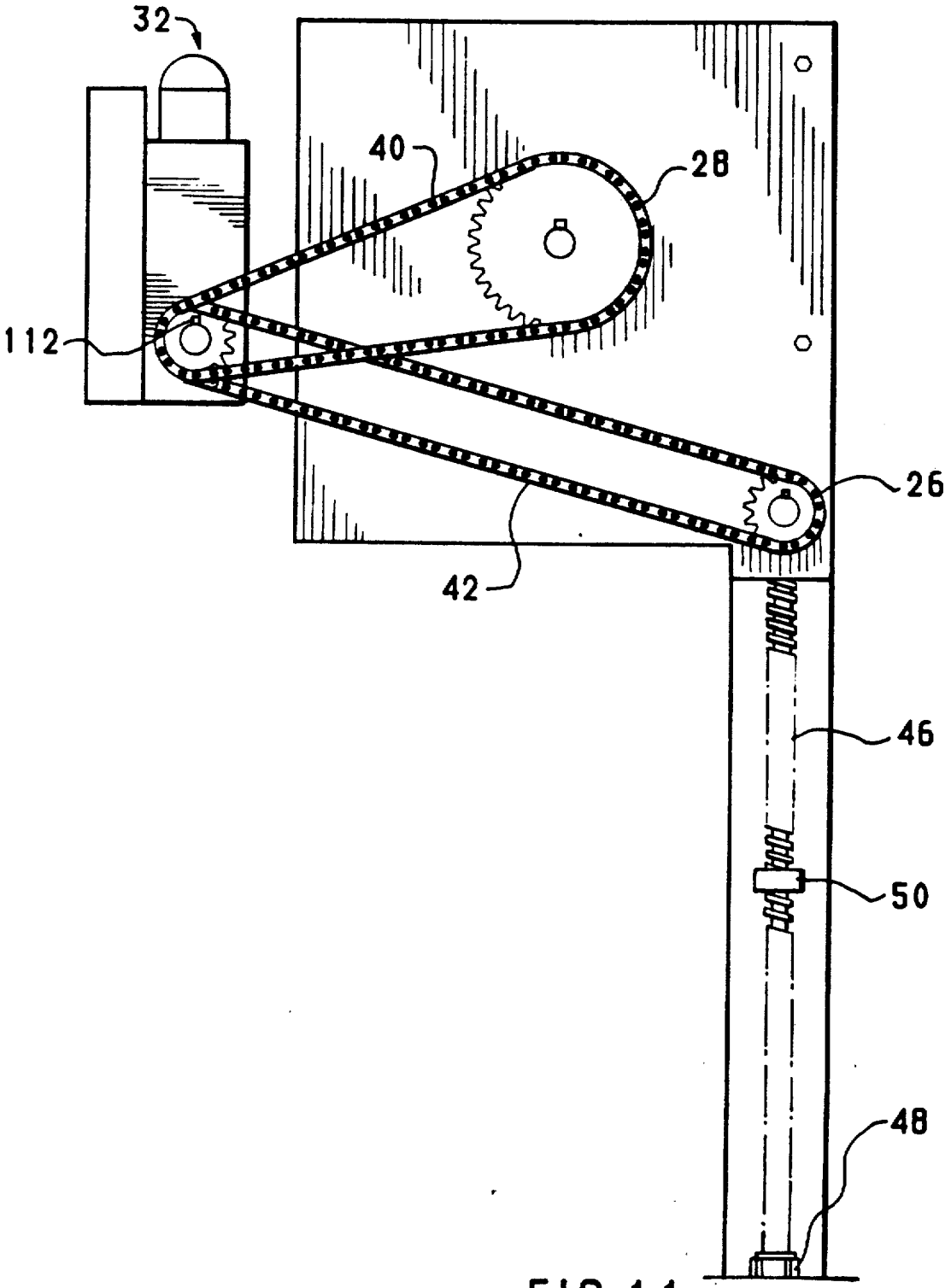
FIG. 11 is a side view of the embodiment of FIG. 1.

As illustrated in FIG. 5, clutch shaft 34 has two circumferential bearing surfaces 62 and 64 on opposite sides of external thread 66. At each end of clutch shaft 34, ring groove 68 extends circumferentially about the shaft and below the surface of bearing surfaces 62 and 64. A central bore 70 extends axially of clutch shaft 34. One end of the central bore 70 is counter-bored presenting a larger diameter bore 72. Along the length of central bore 70, keyway 74 extends axially from one end of the clutch shaft 34 to the counter-bore 72. At the end of clutch shaft 34 opposite counter-bore 72, a pair of tapped bores 76 spaced at right angles to each other extend radially through bearing surface 74 to central bore 70.

Screw hub 60 has a central hub 78 having an internally tapped bore 80 extending axially thereof. The screw thread of bore 80 is complementary with external thread 66 of clutch shaft 34. Preferably, the threads can be one of any known threading suitable for power transmission.

Extending from opposite ends of hub 78 are flanges 82 presenting a substantially planar frictional surface 84. The inside corner between flange 82 and hub 78 is illustrated as having a weld 86. However, hub 78 and flanges 82 can be manufactured as an integral unit.

Sprocket 36 has an axially extending central bore 88 having at each end of the bore a counter-bore 90. Bearing 92 is placed within counter-bore 90 to present a circumferentially extending inside bearing surface. Sprocket teeth 94 extend radially at one end of take-up drive sprocket 36. Flange 96 extends from the end opposite teeth 94. However, sprocket 36 and flange 96 can be manufactured as an integral unit. Idler drive sprocket 38 is identical to the construction of take-up drive sprocket 36 although the number of teeth may vary depending on the ratios and speed desired.

Collar 54 comprises a ring having a central bore 98 extending axially therethrough. Extending into one of the axial surfaces of collar 54 is a plurality of bores 100 having a diameter to receive compression springs 99 therein. Compression springs 99 may be replaced by spring discs where loads warrant such change.

Thrust bearing 56 comprises a pair of thrust washers 102. Sandwiched between the thrust washers 102 is a thrust assembly 104 having bearing material 106 extending circumferentially on each face of thrust assembly 104. Each thrust washer and thrust assembly has an axially extending circular opening.

Friction disc 58 comprises a ring of clutch or brake material having a central circular opening 108. Depending on the desired loads, friction disc 58 could comprise two rings of clutch or brake material sandwiched between a metallic ring.

Drive motor 32 has a motor shaft 110 extending therefrom. Motor shaft 110 will have a diameter complementary to the internal bore 70 and counter-bore 72 of clutch shaft 34. Along the narrower diameter portion of the shaft, motor shaft 110 has a keyway complementary to keyway 74. Drive motor 32 is of the type operable to drive shaft 110 in either rotation or counter-rotation direction.

Figure 17:
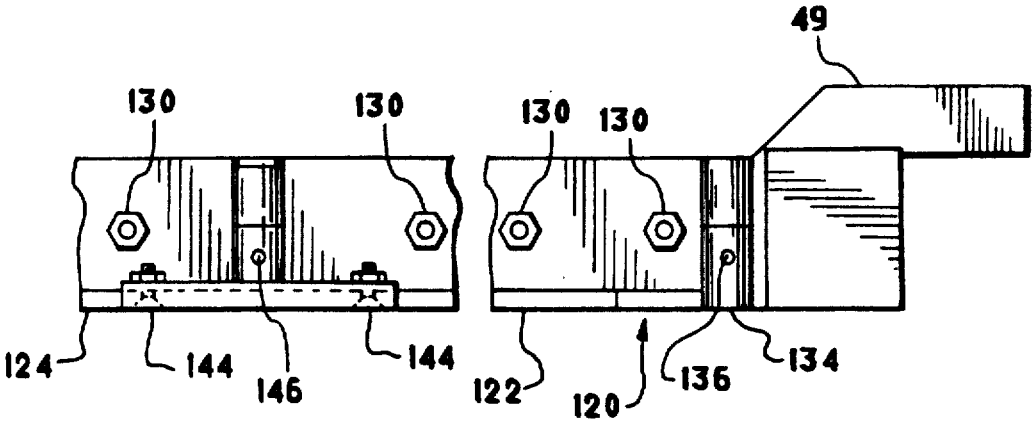
FIG. 17 is a front view of the lower edge component of the embodiment of FIG. 1.
Figure 18:
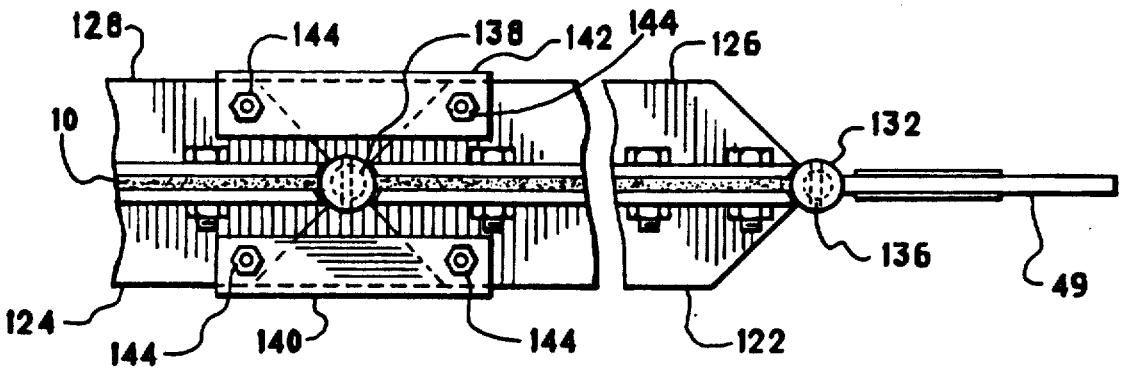
FIG. 18 is a top sectional view of the lower edge component of the embodiment of FIG. 17.

With reference to FIGS. 17 and 18, the leading edge of door curtain 10 has a bottom bar 120. Bottom bar 120 comprises four L-shaped bars 122, 124, 126 and 128 joined to the leading edge of the door curtain 10 by a plurality of nuts and bolts 130. The lower horizontal corners of each bar 122, 124, 126 and 128 have been removed as illustrated in FIG. 18.

Bar 126 has at one end thereof a gudgeon 132 adapted to receive a pintle 134 extending from edge component 49 in a hinged connection. Pintle 134 has an internal bore for receiving a bolt for increasing the frictional engagement between the pintle and gudgeon. Pintle 134 has a transversely extending bore 136 for receiving a shear pin.

Bars 122 and 124 also have a gudgeon on the lower edge and at one end thereof. Bar 128 has a gudgeon on the upper edge and at one thereof.

To install the bars onto the door curtain 10, the lower edge of the curtain 10 has a slot cut on the leading edge near the mid-point of the width of the curtain. The bars are bolted onto the leading edge with a lower gudgeon extending from each side of the leading edge. The gudgeons of bars 122 and 128 meet at the slot cut into the leading edge of the curtain. A pin 138 is inserted through the opening presented when the gudgeons of bars 122 and 128 are aligned. Pin 134 is provided with a transversely extending bore. Bore 146 is provided in the lower gudgeon of bar 122. A shear pin is inserted through bore 146 and pin 134.

Tabs 140 and 142 are bolted onto bars 122 and 124 and onto bars 126 and 128, respectively with nut and bolt 144 to form a rigid connection between bars. When the curtain 10 is impacted and the impact exceeds a pre-determined force, the shear pins will fracture absorbing the energy of the impact before tabs 140 or 142 become deformed. The leading edge of the door curtain can be repaired by replacing the shear pins.

To assemble, screw hub 60 is screwingly engaged with the external thread 66 of clutch shaft 34 until its rests at substantially the midway point of the length of the shaft. Friction disc 58 is mounted onto clutch shaft 34. One friction disc is mounted on each side of screw hub 60. Idler drive sprocket 38 is mounted onto shaft 34 until flange 96 abuts with friction disc 58. Similarly, take-up drive sprocket 36 is mounted onto shaft 34 from an end opposite that of idler drive sprocket 38. As is apparent, screw hub 60 will be sandwiched between take-up drive sprocket 36 and idler drive sprocket 38. A thrust bearing 56 is mounted on each end of clutch shaft 34 until it abuts with sprocket 36 and 38 respectively.

Compression springs 99 are inserted into bores 100 of collar 54. Collar 54 is then mounted onto the shaft 34 until the face having bores 100 abuts with the thrust bearing 56 nearest the idler drive sprocket 38. Retaining ring 52 is an applied about the shaft 34 until it rests within ring groove 68 presenting an abutment surface preventing collar 34 from sliding off shaft 34. Compression springs 99 bias the thrust bearing 56 towards the idler drive sprocket 38.

The partially assembled clutch 30 is then mounted onto motor shaft 110. Key 112 is applied to the keyway 74 until fully registered therein. Hex bolts 114 are screwingly engaged into tapped bores 76 of clutch shaft 34 until the heads of hex bolts 114 rest below the surface of bearing surface 64 and retain the clutch shaft 34 onto motor shaft 110.

A second collar 54 having compression springs 99 inserted within bores 100 is applied to over the end of shaft 34 until it abuts with thrust bearing 56. A second retaining ring 52 is applied to retaining ring groove 68 fully securing collar 54 onto shaft 34. Compression springs 99 bias the thrust bearing 56 towards the take-up drive sprocket 36.

The distance between ring grooves 68 at each end of the shaft 34 must be such that when clutch 30 is fully assembled, screw hub 60 is able to move axially relative to sprockets 36 and 38. When screw hub 60 is closer to sprocket 36 than sprocket 38, sprocket 38 is able to freely rotate. Equally, when screw hub 60 is closer to sprocket 38 than sprocket 36, sprocket 36 is able to freely rotate.

Upon rotation of shaft 34, screw hub 60 will advance along the external thread 66, causing screw hub 60 to move relatively closer to sprocket 36. Upon further advancement of screw hub 60 along shaft 34 towards sprocket 36, the frictional forces between friction disc 58 and screw hub 60 and sprocket 36 will increase up to a point where screw hub 60 and sprocket 36 will rotate together with rotation of screw shaft 34.

Upon counter rotation of the shaft 34, screw hub 60 will retract along the external thread 66 and become disengaged from sprocket 36. Screw hub 60 will continue to detract and move relatively closer to sprocket 38 than sprocket 36 until the frictional forces between screw hub 60 and frictional disc 58 and frictional disc 58 and sprocket 38 increase until screw hub 60 and sprocket 38 rotate together with shaft 34.

When screw hub 60 is rotating together with either sprocket 36 or 38, the opposite sprocket is permitted to freely rotate about the shaft 34.

In operation, upon drivingly rotating idler drive sprocket 38, idler chain 42 rotates idler sprocket 26 and in turn causes idler axle 24 and idler roller 22 to rotate. Idler roller 22 guides the door curtain into the guide channels 20 of frame 18. Rotation of axle 24 and roller 22 causes gear 44 to rotate and in turn causing shaft 46 to rotate. Since dog 50 is not permitted to rotate, it will screwingly advance along the length of shaft 46. Upon rotation of shaft 46, door curtain 10 will be unrolled from take-up roller 14 and opening 12 becomes closed as dog 50 travels down shaft 46.

Upon drivingly rotating take-up drive sprocket 36 will cause take-up chain 40 to drivingly rotate take-up sprocket 28. Take-up sprocket 28 will cause take-up axle 16 to rotate causing take-up roller 14 to rotate. Upon rotation of the take-up roller 14, door curtain 10 will be rolled up opening door opening 12.

Drive sprocket 38 will cause door curtain 10 to close while take-up drive sprocket 36 is disengaged from the drive allowing it to freely rotate. Since take-up drive sprocket 36 freely rotates, take-up roller 14 is free to rotate as the door curtain 10 advances downwardly to close door opening 12. Conversely, when take-up drive sprocket 36 drivingly rotates take-up barrel 14, idler drive sprocket freely rotates permitting idler barrel 22 to freely rotate as door curtain 10 advances upwardly to open door opening 12.

Clutch 30 also acts as a brake when the operator 29 is not in operation. As motor 32 is de-energized, clutch 30 stops acting as a clutch and acts as a brake stopping the door curtain 10 and maintaining the door curtain 10 where it was stopped.

Dog 50 is releasably connected to edge component 49 to permit emergency opening of the door curtain 10. Since clutch 30 will have driven the door curtain to a closed position, take-up roller will still be free to rotate. By releasing dog 50 from edge component 49, take-up roller is free to rotate rolling up the door curtain to an open condition.

Optionally, one edge of channel 20 can be spring loaded to urge the door curtain 10 towards the other edge of edge channel 20. The advantage would be to establish a positive seal between the door curtain and frame 18 so that the greater pressure differentials could exist between opposite sides of the door.

Figure 12:
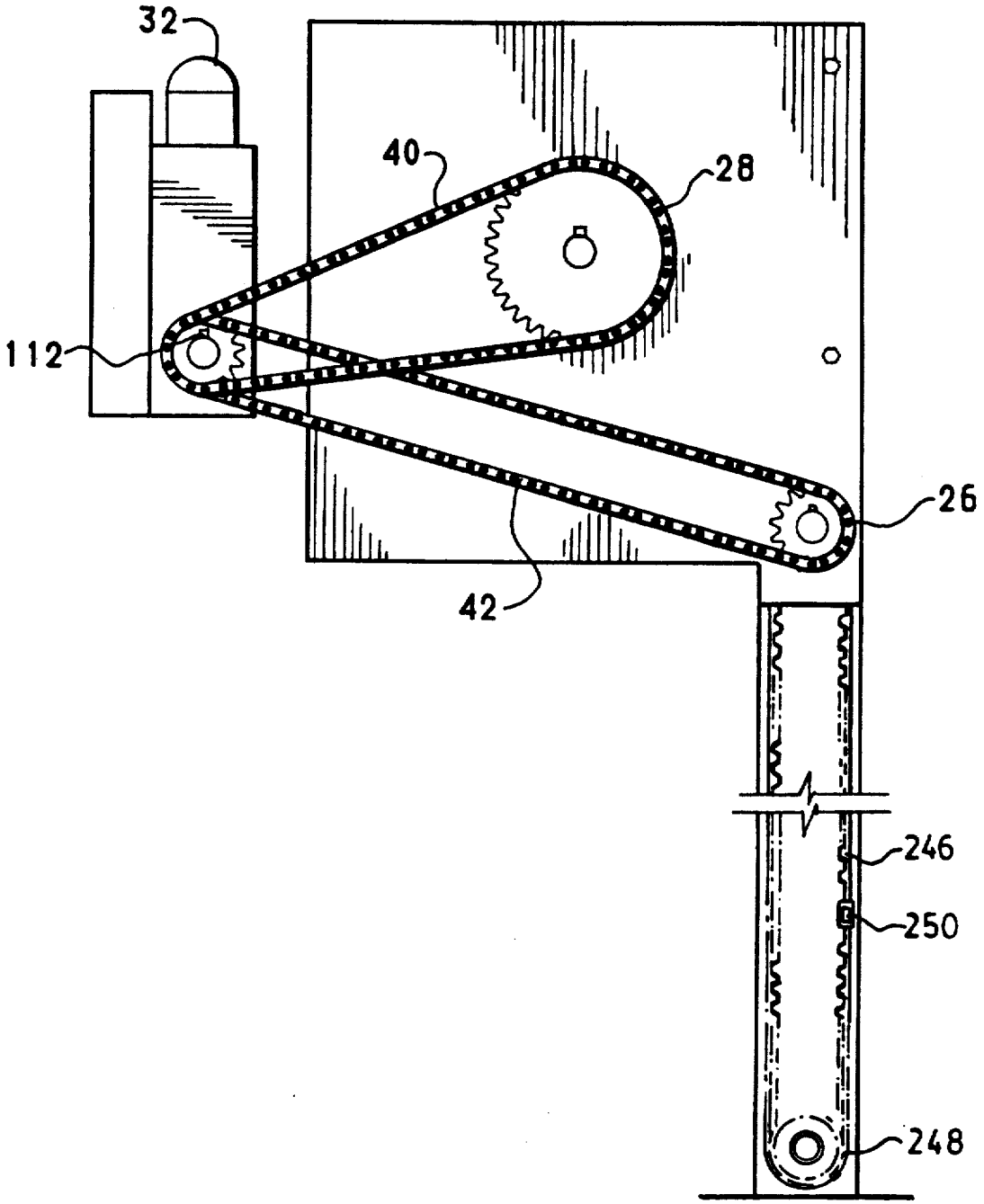
FIG. 12 is a side view of the embodiment having a belt drive.
Figure 13:
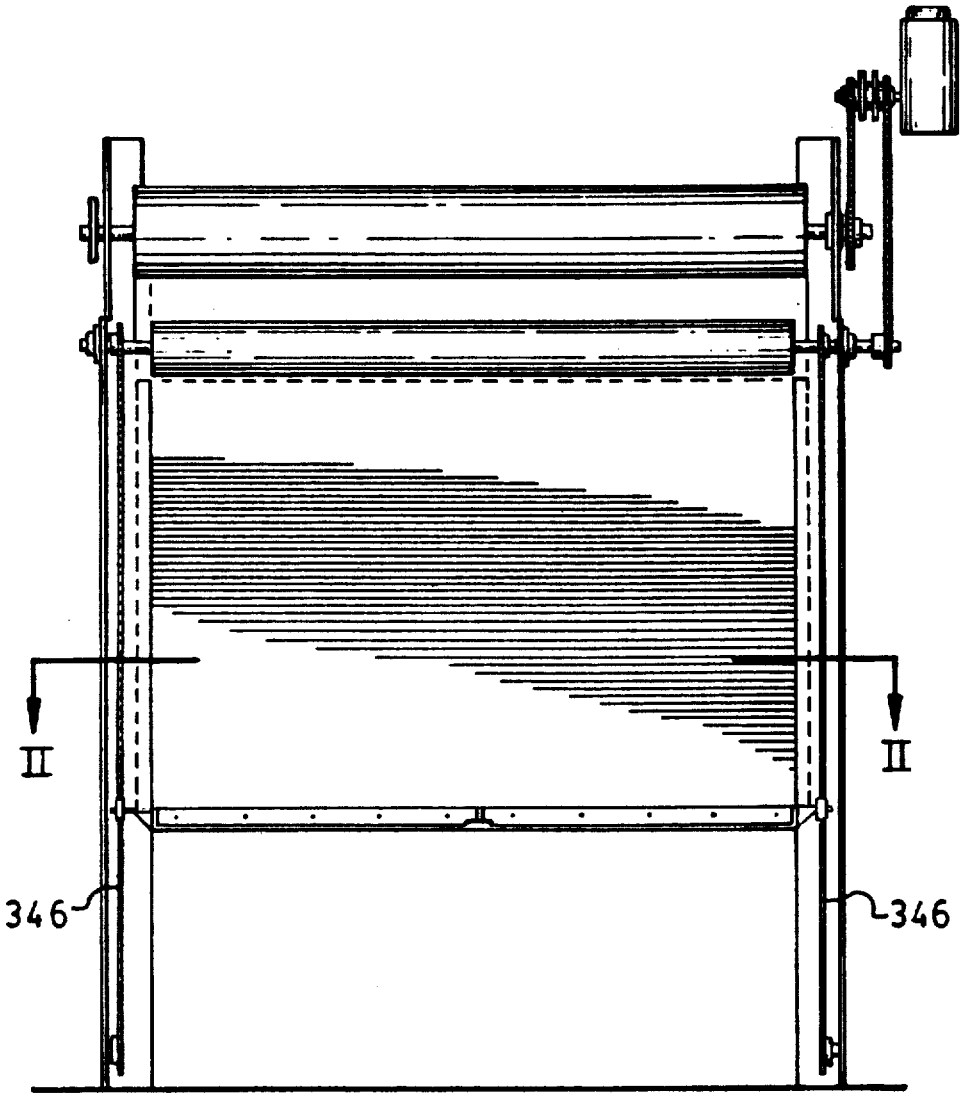
FIG. 13 is a front elevational view of the roller door and operator according to the embodiment having a chain drive.
Figure 14:
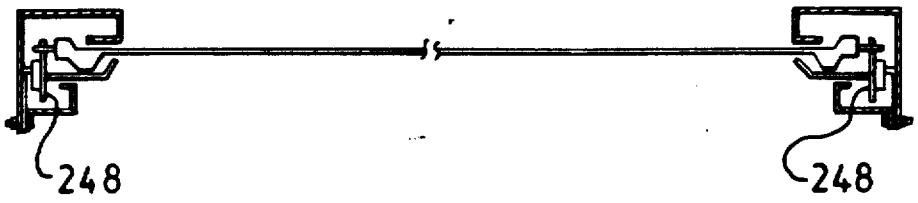
FIG. 14 is a sectional view along the line II—II of the embodiment of FIG. 13 illustrating the door within the side channels.
Figure 15:
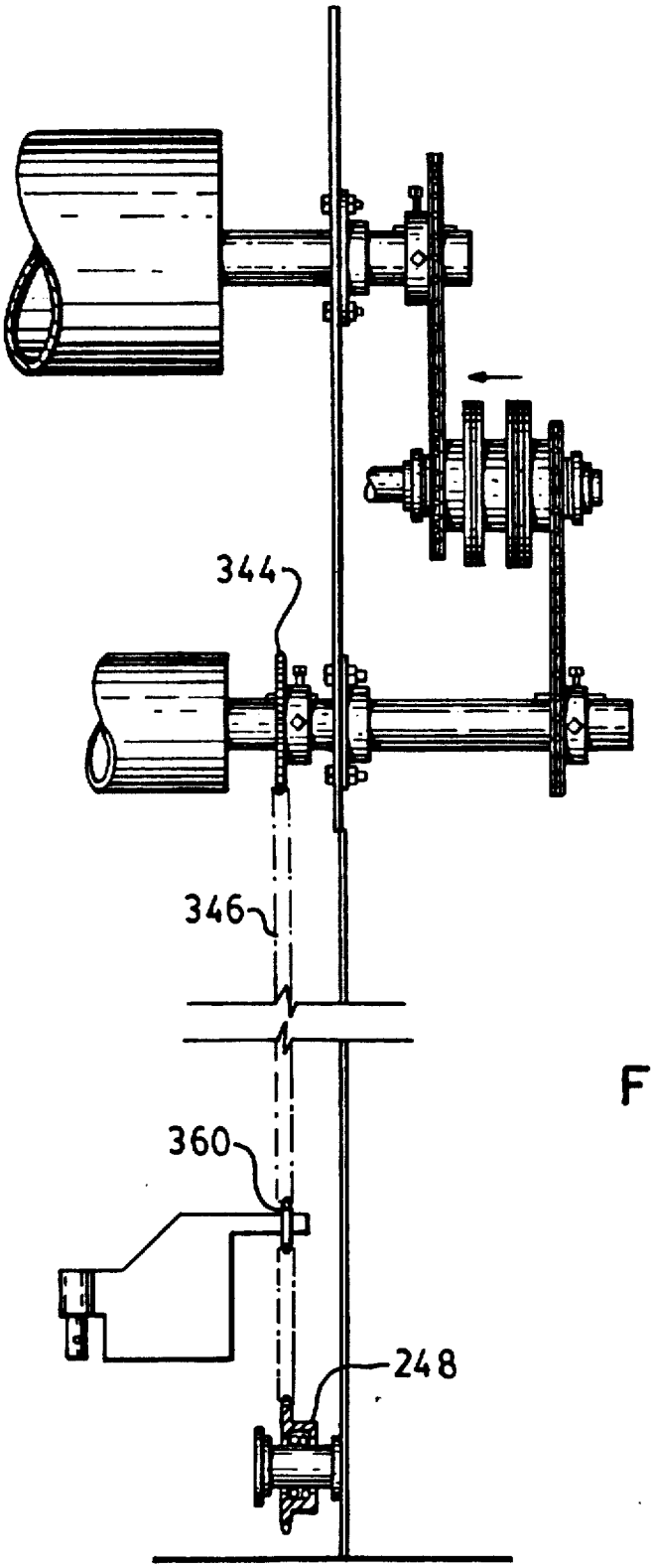
FIG. 15 is a partial front elevational view of the embodiment of FIG. 13.
Figure 16:
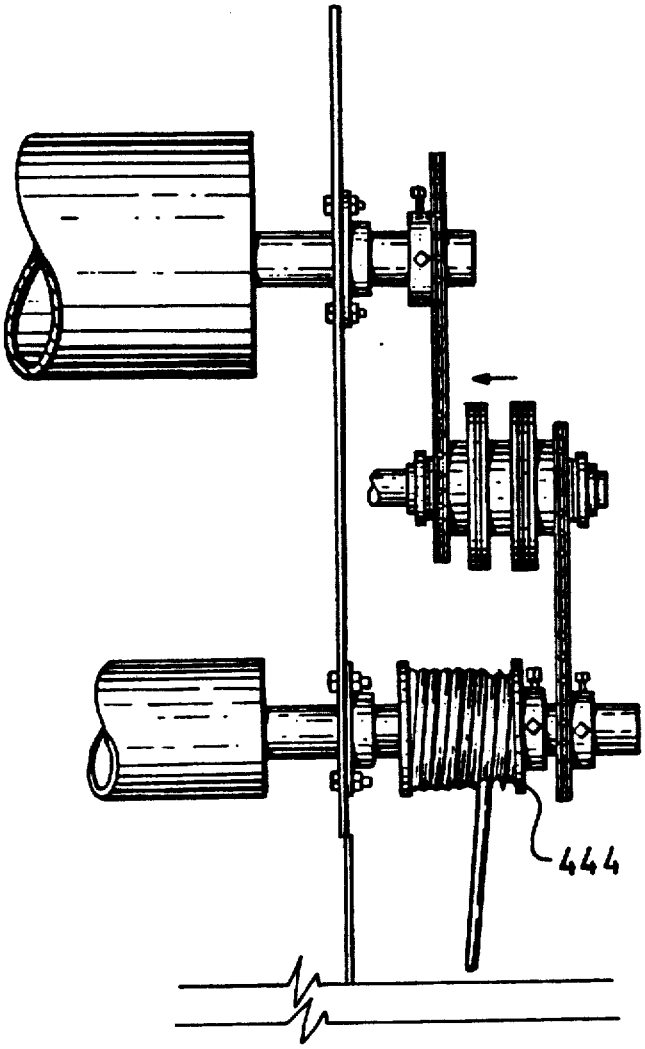
FIG. 16 is a side view of the embodiment having a cable drive.
Figure 16:
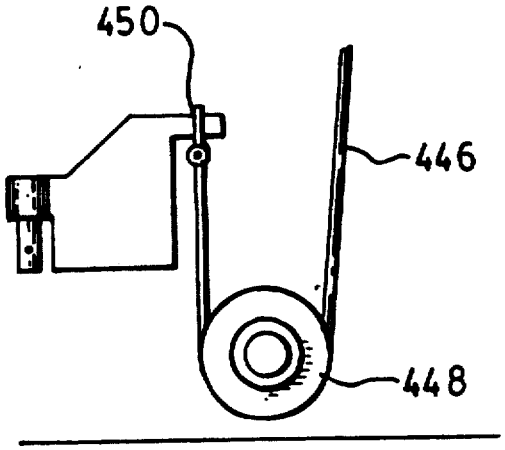

As illustrated in FIGS. 12 to 16, the method used to drive the door curtain 10 to a closed position may be of any known variety. FIG. 12 illustrates a belt drive closing the door. FIGS. 13 to 15 illustrates a chain drive arrangement. FIG. 16 illustrates a cable drive arrangement.

In FIG. 12, take-down gear 44, take-down screw 46, base pads 48 and dog 50 is replaced by a sprocket, toothed belt 246, lower gear 248 and dog 250, respectively.

In FIGS. 13 to 15, take-down gear 44, take-down screw 46, base pads 48 and dog 50 is replaced by a sprocket 344, endless chain 346, lower gear 348 and dog 350, respectively.

In FIG. 16, take-down gear 44, take-down screw 46, base pads 48 and dog 50 is replaced by a spool 444, cable 446, lower gear 448 and dog 450, respectively.

It will be obvious to those skilled in the art that various modifications and changes can be made to the operating system without departing from the spirit and scope of this invention. Accordingly, all such modifications and changes as fall within the scope of the appended claims are intended to be part of this invention.

I claim:

1. A selective clutch for selectively rotating at least two disc means, comprising:

a shaft having an external thread bounded by a first and second bearing surface;

a hub having an axially extending threaded opening for screwingly engaging the thread of said shaft;

a first disc means rotatably mounted on said first bearing surface;

a second disc means rotatably mounted on said second bearing surface;

abutment means on opposite sides of said first and second disc means for retaining said first and second disc means on said shaft;

first and second biasing means between said first disc means and abutment means and said second disc means and abutment means, respectively, urging said disc means in frictional contact with said hub, whereby rotation of said shaft said hub advances therealong and frictionally engages said first disc means until said first disc means and shaft rotate together and said second disc means freely rotates and counter rotation of said shaft said hub advances back along said shaft and frictionally engages said second disc means until said second disc means and shaft rotate together and said first disc means freely rotates.

2. A selective clutch as claimed in claim 1 wherein said clutch further comprises a first and second friction disc for increasing the frictional engagement between said first disc means and hub and between said second disc means and hub, respectively.

3. A selective clutch as claimed in claim 2 wherein said hub has at opposite ends thereof flanges for increasing the contact surface between said hub and disc means.

4. A selective clutch as claimed in claim 3 wherein said first and second friction disc means comprises a metallic ring sandwiched between at least two rings of clutch or brake material.

5. A selective clutch as claimed in claim 4 wherein abutment means comprises a first and second collar, a retaining ring and a circumferentially extending groove on said shaft for receiving said retaining ring and said biasing means comprises a thrust bearing, a plurality of springs and said first and second collar is adapted to receive said plurality of springs in a face of each collar.

6. A selective clutch as claimed in claim 5 wherein said first and second disc means comprises a first flange at one side thereof for engaging said flange of said hub and the opposite side thereof is adapted to transmit rotational forces.

7. A selective clutch as claimed in claim 6 wherein said clutch is operably mounted on a drive shaft of a drive means for drivingly rotating said shaft and said first disc means is operably connected to a leading edge of a door curtain for drivingly closing a door opening and said second disc means is operably connected to a trailing edge of said door curtain for drivingly opening the door opening.

8. A rolling door assembly comprising a door curtain having a trailing edge mounted connected to a first roller for rolling and unrolling the door curtain between a closed and open condition, a guide means mounted about the sides of the door opening operable to guide the edges of the door curtain during the door rolling and unrolling and to seal the sides of the door opening when in a closed condition, a second roller mounted at the top of the door opening for urging the door curtain into the guide means, take-down means operably connected to the second roller for driving the leading edge of the door to a closed condition, and operator means for selectively driving the first roller and the second roller for, wherein the improvement is characterized by a shaft having an external thread bounded by a first and second bearing surface, a hub screwingly engaging the shaft and adapted to travel along the shaft, a first disc means rotatably mounted on said first bearing surface and operably connected with the first roller and a second disc means mounted on said second bearing surface and operably connected with said second roller, and abutment means on opposite sides of said first and second disc means, whereby upon rotation of said shaft said hub advances along said shaft and frictionally engages said first disc means until said first disc means and shaft rotate together and said second disc means freely rotates and upon counter rotation of said shaft said hub advances back along said shaft and frictionally engages said second disc means until said second disc means and shaft rotate together and said first disc means freely rotates.

9. A rolling door assembly as claimed in claim 8 wherein said hub has at opposite ends thereof flanges for increasing the contact surface between said hub and disc means.

10. A rolling door assembly as claimed in claim 9 wherein said operator further comprises a first and second friction disc for increasing the frictional engagement between said first disc means and hub and between said second disc means and hub, respectively.

11. A rolling door assembly as claimed in claim 10 wherein said first and second friction disc means comprises a metallic ring sandwiched between at least two rings of clutch or brake material.

12. A rolling door assembly as claimed in claim 11 wherein abutment means comprises a first and second collar, a retaining ring and a circumferentially extending groove on said shaft for receiving said retaining ring and said biasing means comprises a thrust bearing, a plurality of compression springs and said first and second collar is adapted to receive said plurality of compression springs in a face of each collar.

13. A rolling door assembly as claimed in claim 12 wherein said first and second disc means comprises a first flange at one side thereof for engaging said flange of said hub and the opposite side thereof is adapted to transmit rotational forces.

14. A rolling door assembly as claimed in claim 13 wherein said operable connection between said disc means and said rollers is an endless chain and sprocket arrangement wherein said rollers are mounted on axles and each axle has a sprocket mounted thereon for receiving an endless chain.

15. A rolling door assembly as claimed in claim 14 wherein said take-down means is an endless chain mounted within said guide means between a first sprocket mounted on said axle of said second roller and a second sprocket mounted at the base of said guide means.

16. A rolling door assembly as claimed in claim 15 wherein said leading edge of door curtain has a plurality of L-shaped bars connected thereto and rigidly and hingedly connected to each other and to means for connecting said bars to said take-down means, wherein a shear pin is inserted through each of said hinged connection, said shear pins are adapted to fail prior to failure of said rigid connection upon impact of said door curtain.

17. A rolling door assembly as claimed in claim 14 wherein said take-down means is an endless belt mounted within said guide means between a first sprocket mounted on said axle of said second roller and a second sprocket mounted at the base of said guide means.

18. A rolling door assembly as claimed in claim 14 wherein said take-down means is a cable mounted within said guide means between a spool mounted on said axle of said second roller and a pulley mounted at the base of said guide means and said cable extend about said spool about said pulley and connected to said leading edge of said door curtain.

19. A rolling door assembly as claimed in claim 14 wherein said take-down means is a screw shaft mounted within said guide means between a first gear mounted on said axle of said second roller and a second gear mounted at one end of said screw of said guide means and rotatably mounted at the base of said guide means and having a dog screwingly engaging said screw shaft, said dog connected to said leading edge of said door curtain.

* * * * *